US007340935B2

(12) United States Patent
Ohtsuka et al.

(10) Patent No.: US 7,340,935 B2
(45) Date of Patent: Mar. 11, 2008

(54) EQUIPMENT FOR PRODUCING CORRUGATE FIN

(75) Inventors: Kazuyoshi Ohtsuka, Tokyo (JP); Masanao Karasawa, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 177 days.

(21) Appl. No.: 11/359,547

(22) Filed: Feb. 23, 2006

(65) Prior Publication Data

US 2006/0193939 A1 Aug. 31, 2006

(30) Foreign Application Priority Data

Feb. 25, 2005 (JP) ..... 2005-051396
Feb. 7, 2006 (JP) ..... 2006-029568

(51) Int. Cl.
*B21D 13/02* (2006.01)

(52) U.S. Cl. ..... 72/385; 72/403; 72/414; 72/452.9

(58) Field of Classification Search ..... 72/385, 72/384, 403, 381, 452.8, 452.9, 414
See application file for complete search history.

(56) References Cited

U.S. PATENT DOCUMENTS 3,439,521 A * 4/1969 Tetart ..... 72/399
3,673,846 A * 7/1972 Levington et al. ..... 72/326
3,726,121 A * 4/1973 Arnold et al. ..... 72/402
3,845,654 A * 11/1974 Fuller et al. ..... 72/381
4,635,462 A * 1/1987 Bald ..... 72/385

FOREIGN PATENT DOCUMENTS

JP 2003-115567 A 4/2003
JP 2004-223686 A 8/2004

* cited by examiner

*Primary Examiner*—Daniel C Crane
(74) *Attorney, Agent, or Firm*—Birch, Stewart, Kolasch & Birch, LLP

(57) ABSTRACT

The equipment for producing a corrugate fin is capable of forming corrugated sections by one closing action. The equipment comprises: a plurality of punches respectively having projections, each of which is upwardly projected from an upper face of the punch and has a side slope face; a pair of cam blocks being capable of relatively moving close and away each other, the cam blocks respectively having pressing sections, which are capable of moving along the side slope faces and contacting the projections; and a cam plate relatively moving the cam blocks close or away each other. Positions of the side slope faces of the projections are different so as to make the pressing sections contact the projections in order, and the cam blocks move the punches toward the die in order by one closing action of the blocks.

4 Claims, 14 Drawing Sheets

EQUIPMENT FOR PRODUCING CORRUGATE FIN

BACKGROUND OF THE INVENTION

The present invention relates to an equipment for producing a corrugate fin, which is used for a heat exchanger.

Corrugate fins are used in, for example, air conditioners for vehicles. An example of the corrugate fins is shown in FIGS. 21 and 22. The corrugate fin 10 is made of a thin metal plate having a plurality of corrugated sections 12, which are formed like waves. The corrugate fin 10 is provided in a tube. By using the corrugate fin 10, heat exchange with a heat medium running through the tube can be effectively performed.

When the corrugate fin 10 is produced, the metal plate must be drawn, so all of the corrugated sections 12 cannot be formed at a time. The corrugated sections 12 must be formed in order.

Conventionally, the corrugated sections 12 are formed by a press machine. However, the press machine forms one corrugated section 12 by one press action. Therefore, production efficiency is low.

To solve the problem of the low production efficiency, a plurality of gear-shaped forming rolls, which clamp a metal plate, are used. The metal plate is fed to the forming rolls in series so as to form the corrugated sections 12 in order (see Japanese Patent Gazette No. 2004-223686).

Production efficiency of the method disclosed in Japanese Patent Gazette No. 2004-223686 is higher than that of the conventional method, in which one corrugated section is produced by one press action. However, this method can form circular arc corrugated sections, but cannot form rectangular corrugated sections.

Note that, if the feeding direction of the metal plate fed to the forming rolls is parallel to the longitudinal direction of the corrugated section, the rectangular corrugated section can be formed. But, in this method, a half of the rectangular corrugated section is formed by one press action, so a large number of the forming rolls must be required and a production line must be long.

Thus, an equipment having a plurality of punches, which are driven in order so as to form rectangular corrugated sections, was invented (see Japanese Patent Gazette No. 2003-115567). This equipment is a compact size and capable of efficiently producing rectangular corrugated sections. The equipment is capable of forming a plurality of rectangular corrugated sections by one forming action.

The equipment disclosed in Japanese Patent Gazette No. 2003-115567 is capable of shortening the time for producing corrugate fins and reducing production cost.

The equipment disclosed in Japanese Patent Gazette No. 2003-115567 is used for producing corrugate fins for heat sinks of CPUs, so the corrugate fins can be produced by punches, which are horizontally moved by cylinder units. However, corrugate fins for heat exchangers of air conditioners are much larger and must have higher strength, they cannot be produced by horizontally moving punches. Therefore, an equipment, which is capable of forming a plurality of corrugated sections by one closing action of a lower block and an upper block.

Further, the equipment disclosed in Japanese Patent Gazette No. 2003-115567 has a cam for actuating the punches. The cam is horizontally moved in one direction so as to vertically move the punches. The cam firstly contacts one end of each punch, so a pressing force is applied to the one end only. Further, the pressing force is continuously applied in the moving direction of the punch. Namely, the pressing force, which is inclined with respect to the moving direction of the pupnches, is always applied to the punch.

Since the unsymmetrical pressing force is always applied to the punches, the corrugated sections cannot be precisely produced and the punches and a die are unevenly abraded.

SUMMARY OF THE INVENTION

The present invention was conceived to solve the above described problems.

An object of the present invention is to provide an equipment for producing a corrugate fin having a plurality of corrugated sections, which is capable of forming the corrugated sections by one closing action of a lower block and an upper block and preventing an inclined pressing force, which is inclined with respect to a moving direction of punches, from acting on the punches.

To achieve the object, the present invention has following structures.

Namely, the equipment for producing a corrugate fin having a plurality of corrugated sections from a metal plate, comprises:

a lower die block;

an upper die block being capable of moving to and away from the lower block;

a die being fixed to the lower block;

a plurality of punches being provided to the lower block, located above the die, biased upward by biasing means and capable of independently moving toward the die, the punches respectively having projections, each of which is upwardly projected from an upper face of the punch and each of which has a side slope face;

a pair of cam blocks being capable of relatively moving close and away each other, the cam blocks respectively having pressing sections, which are formed in bottom faces and which are capable of moving along the side slope faces and contacting the projections of the punches so as to press the punches toward the die against a biasing force of the biasing means; and a cam plate being provided to the upper block, the cam plate relatively moving the cam blocks close or away each other in a horizontal plane with the movement of the upper block toward the lower block;

wherein positions of the side slope faces of the projections are different so as to make the pressing sections of the cam blocks contact the projections in order when the cam blocks are relatively moved close or away each other in the horizontal plane, and the cam blocks move the punches toward the die in order by one closing action of the blocks.

With this structure, a plurality of the punches are driven by two cam blocks. The cam blocks are located above the punches and relatively moved close or away each other in the horizontal plane so as to make the pressing sections formed in the bottom face of the cam blocks press the projections formed in the upper faces of the punches. The cam blocks, which are mutually linearly moved in the opposite directions in the horizontal plane, never apply inclined forces, which are inclined with respect to the moving direction of the punches, to the punches. The punches pressed by the cam blocks is moved toward the die without inclining with respect to the moving direction thereof. Namely, the direction of the pressing force is not fixed, and the pressing force is not inclined with respect to the moving direction of the punches.

Since the positions of the side slope faces of the projections are different, the pressing sections of the cam blocks contact the projections at different timings with the horizontal movement of the cam blocks. Therefore, the punches can be driven in order during one closing action of the blocks.

In the equipment, the pressing sections of the cam blocks may be rotatable members, which are capable of freely rotating when the cam blocks are relatively moved close or away each other in the horizontal plane.

With this structure, the rotatable members of the cam blocks contact the projections of the punches, so that frictional resistance, which is generated when the punches are moved toward the die, can be reduced, the punches can be smoothly moved and burning between the cam blocks and the punches can be prevented.

Note that, the rotatable members may be columnar rollers or spherical bodies provided to positions corresponding to the punches.

By employing the equipment of the present invention, a plurality of the punches are driven in order by one closing action of the blocks, so that a plurality of the corrugated sections of the corrugate fin can be formed by one closing action. The punches are pressed downward by moving the cam blocks close or away each other when the blocks are closed, so that no pressing force, which is inclined with respect to the moving direction of the punches, is applied to the punches, the corrugate fin can be precisely produced and uneven abrasion of the punches and the die can be prevented.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
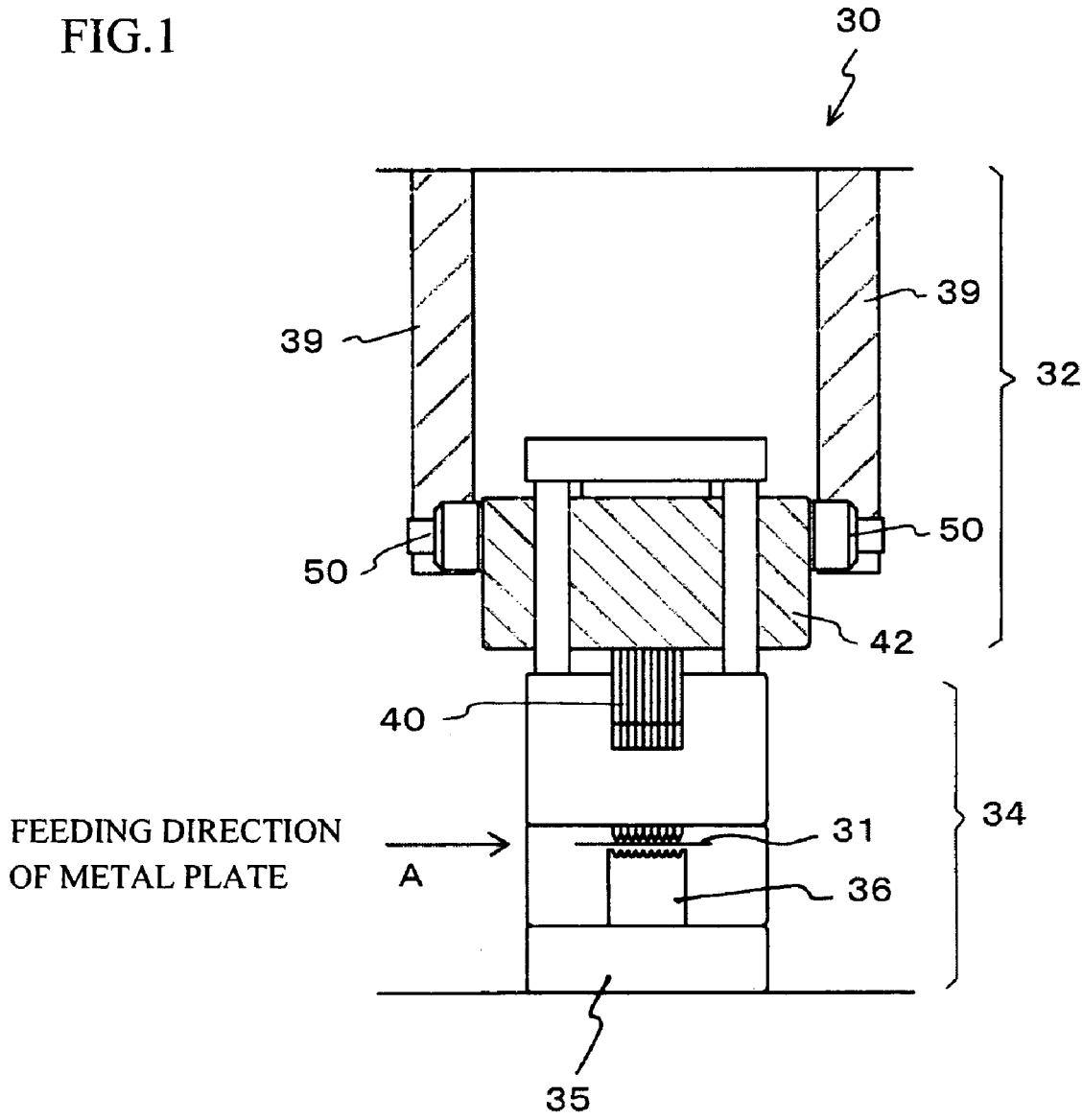
FIG. 1 is a side view of an embodiment of the corrugate fin producing equipment of the present invention.
Figure 2:
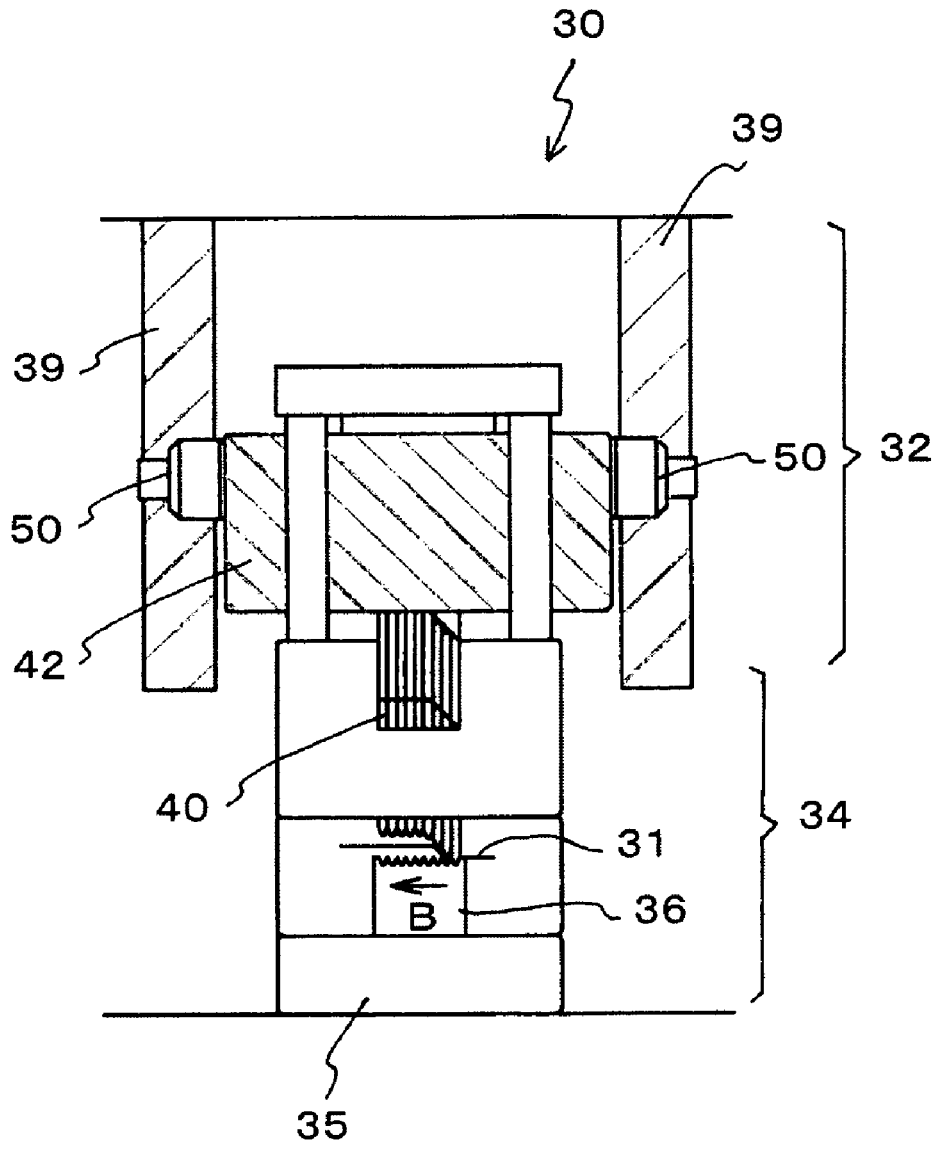
FIG. 2 is a side view of the equipment shown in FIG. 1, wherein punches are moved downward in order.
Figure 3:
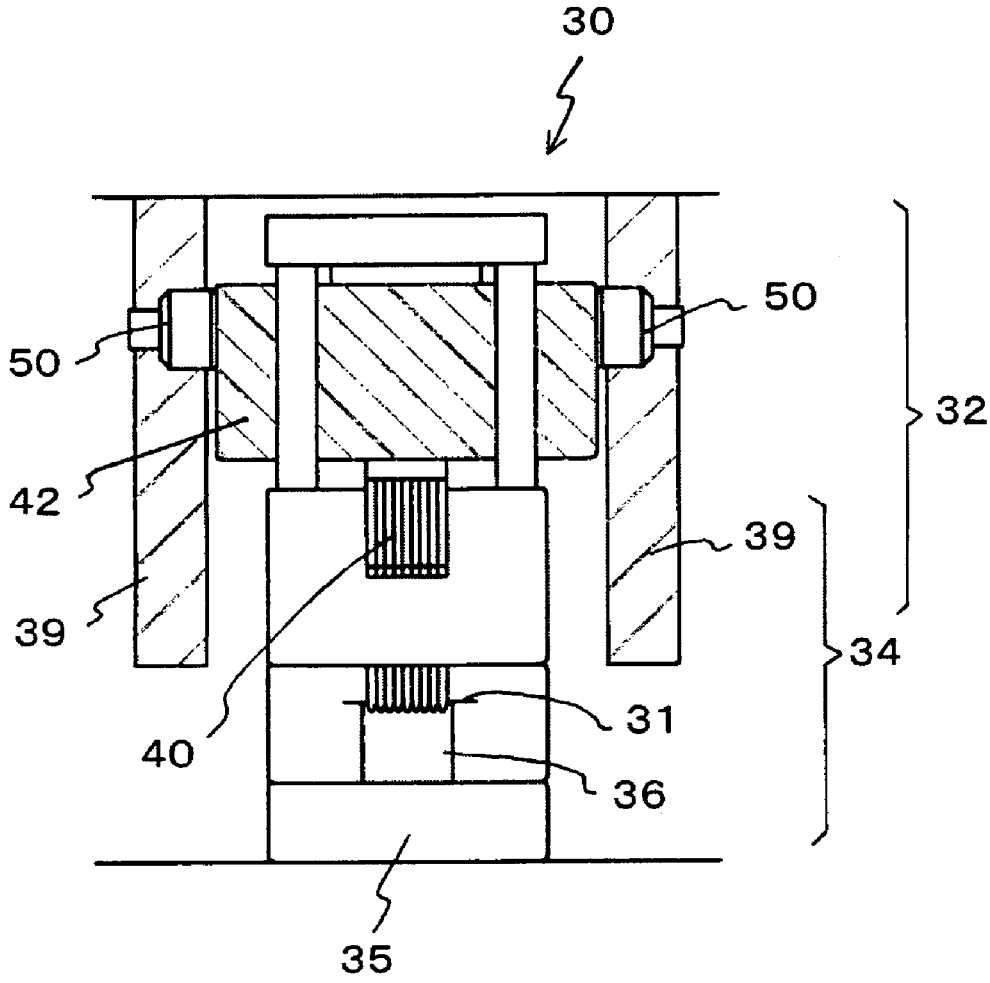
FIG. 3 is a side view of the equipment shown in FIG. 1, wherein all of the punches have been moved downward, and corrugated sections have been formed.
Figure 4:
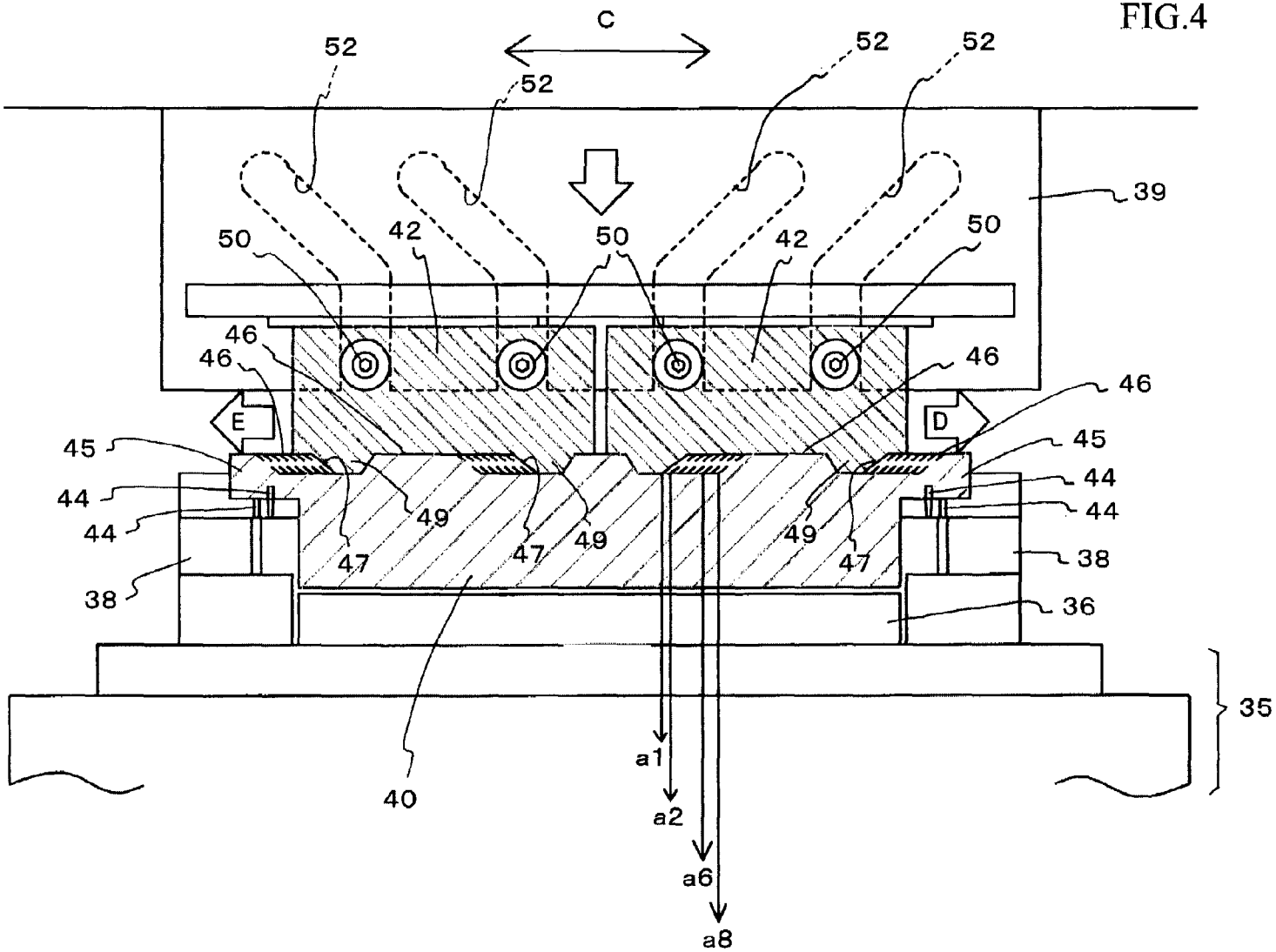
FIG. 4 is a front view of the equipment.
Figure 5:
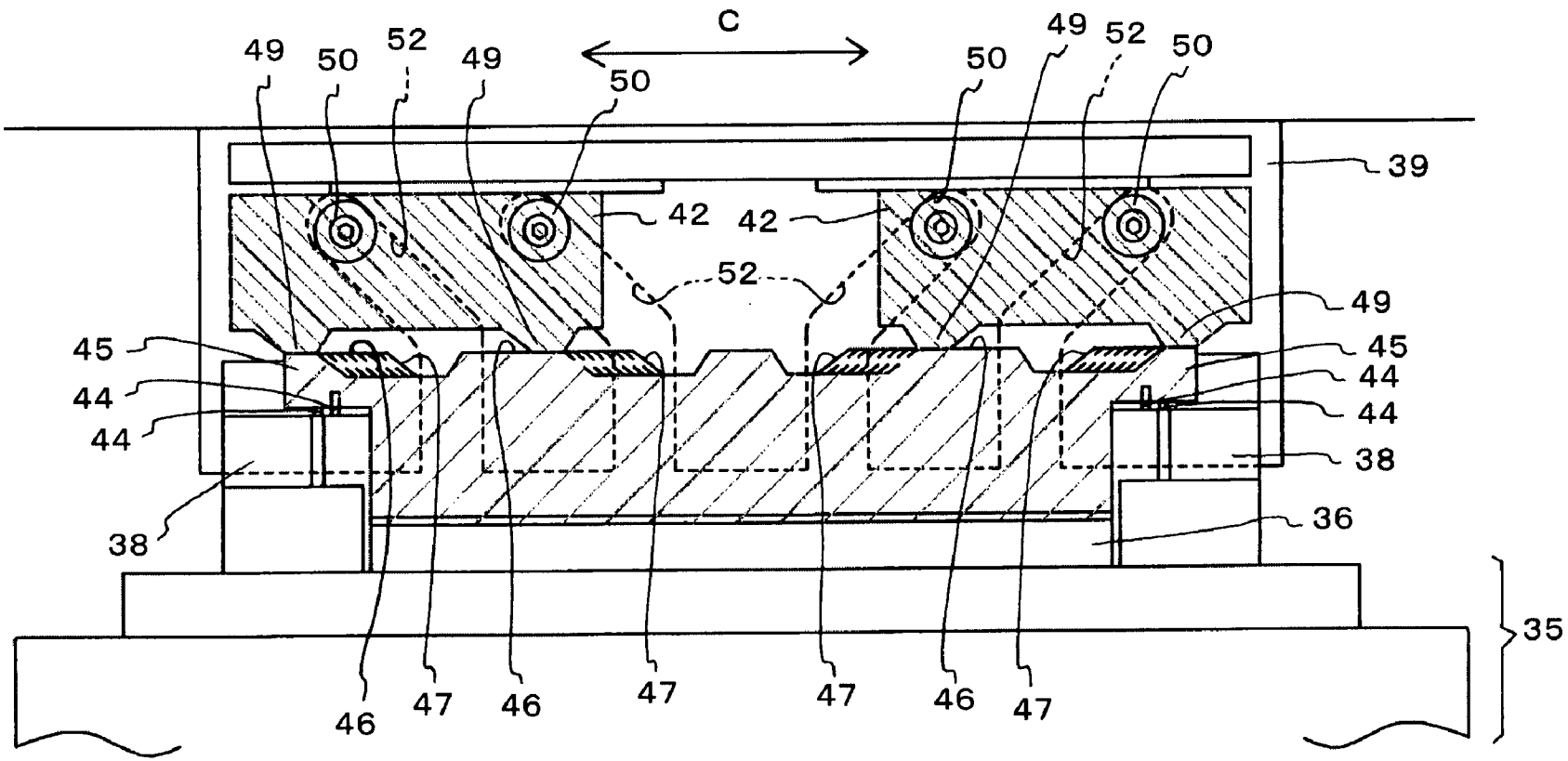
FIG. 5 is a side view of the equipment shown in FIG. 4, wherein all of the punches have been moved downward, and the corrugated sections have been formed.

FIG. 1 is a side view showing an entire structure of the corrugate fin producing equipment of an embodiment. FIGS. 2 and 3 show movements of punches of the equipment shown in FIG. 1. FIGS. 4 and 5 are front views of the equipment shown in FIGS. 1-3.

Figure 22:
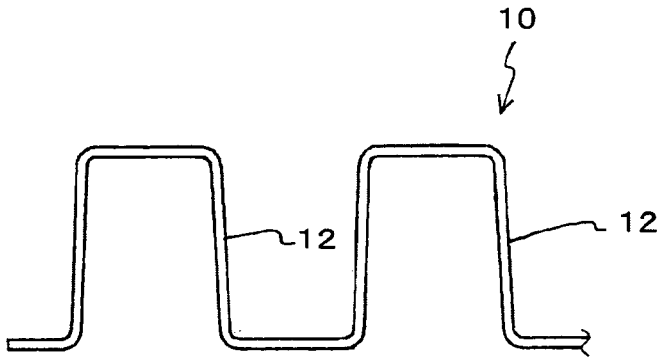
FIG. 22 is a partial sectional view of the corrugate fin.
Figure 21:
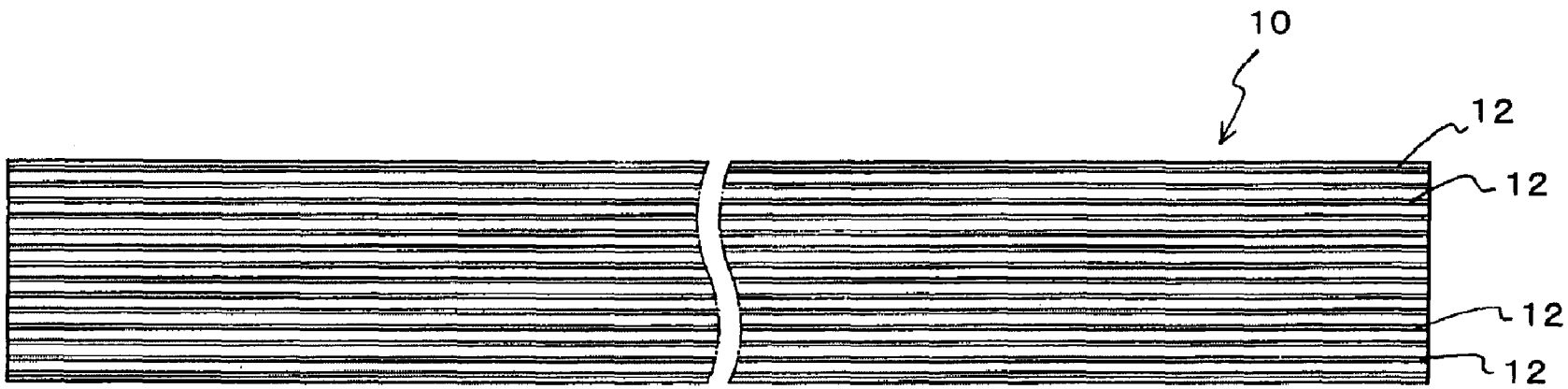
FIG. 21 is a plan view of the corrugate fin.

The corrugate fin producing equipment 30 presses and bends a thin metal plate 31, which is made of, for example, copper, aluminum, etc., so as to produce a corrugate fin 10 having a plurality of corrugated sections 12 (see FIGS. 21 and 22).

The equipment 30 has a lower block 34 and an upper block 32, which can be moved to and away from the lower block 34.

The lower block 34 includes: a base 35; a die 36 fixed to the base 35; a plurality of punches 40; and a pair of cam blocks 42 provided above the punches 40.

The upper block 32 includes: cam plates 39 capable of moving in the vertical direction; and means for vertically moving the cam plates 39, e.g., a hydraulic cylinder unit (not shown).

Firstly, a structure of the lower block 34 will be explained in detail.

The die 36 is fixed on an upper face of the base 35 and has a plurality of concavities 36*a* and convexities 36*b*, which respectively correspond to the corrugated sections 12 to be formed. When bending sections 40*a*, which are respectively formed at lower ends of the punches 40, respectively enter the concavities 36*a* of the die 36, the convexities 36*b* of the die 36 form top parts of the corrugated sections 12 of the corrugate fin 10.

The punches 40 are provided above the die 36 and arranged in a feeding direction A of the metal plate 31.

Each of the punches 40 has the bending section 40*a*, whose width is gradually made thinner toward the lower end and which is capable of clamping the metal plate 31 with the die 36 to form the corrugated section 12. The bending section 40*a* is formed into a mountain-shape, which projects downward and which can be fitted in the corresponding concavity 36*a* of the die 36.

Each of the bending sections 40*a* has a step section 40*b*. With the step section 40*b*, the convexity 36*b* of the die 36 can be fitted between the bending sections 40*a* of the adjacent punches 40. A top end of the convexity 36*b* of the die 36 contacts the step section 40*b* so as to form the top part of the corrugated section 12.

Each of the punches 40 is made wider in a direction C perpendicular to the feeding direction A of the metal plate 31.

Both transverse ends of each punch 40 are formed as attaching sections 45 for attaching the punch 40 to the base 35. The attaching sections 45 of each punch 40 are attached to punch supporting members 38 of the base 35. Biasing means 44 are provided between the attaching sections 45 and the punch supporting members 38 so as to bias the punch 40 upward. For example, coil springs, which are compressible in the vertical direction, are used as the biasing means 44.

A projection 46 is formed in an upper face of each punch 90. On the other hand, a pressing section 49 is formed in a bottom face of each cam block 42. The pressing section 49 presses the projection 46 so as to move the punch 40 downward. Each of the projections 46 has a side slope face 47, so that the pressing section 49 can easily run on the projection 46. In each of the punch 40, four projections 46 are formed in the direction C.

Figure 6:
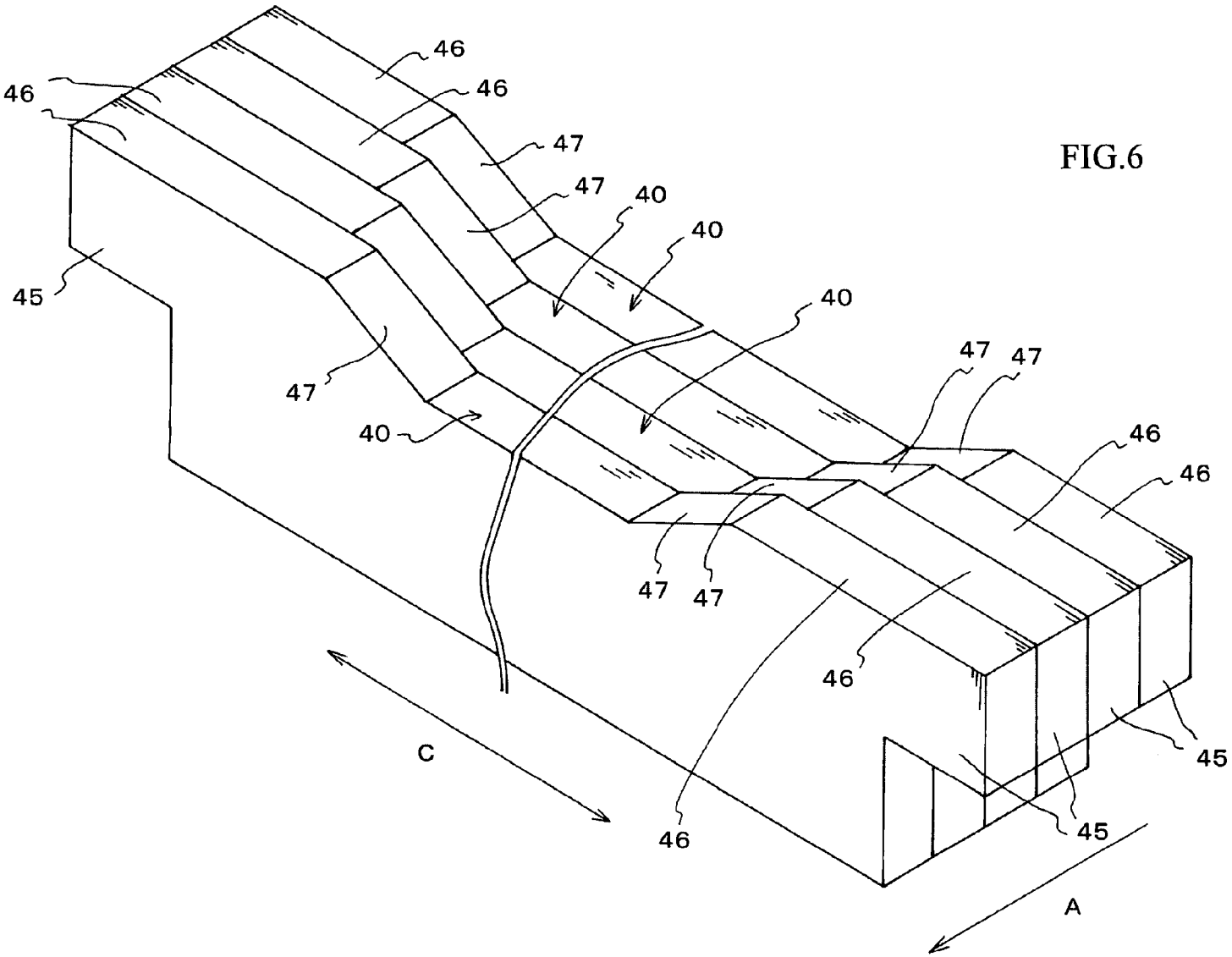
FIG. 6 is an explanation view showing shapes of the punches.
Figure 7:
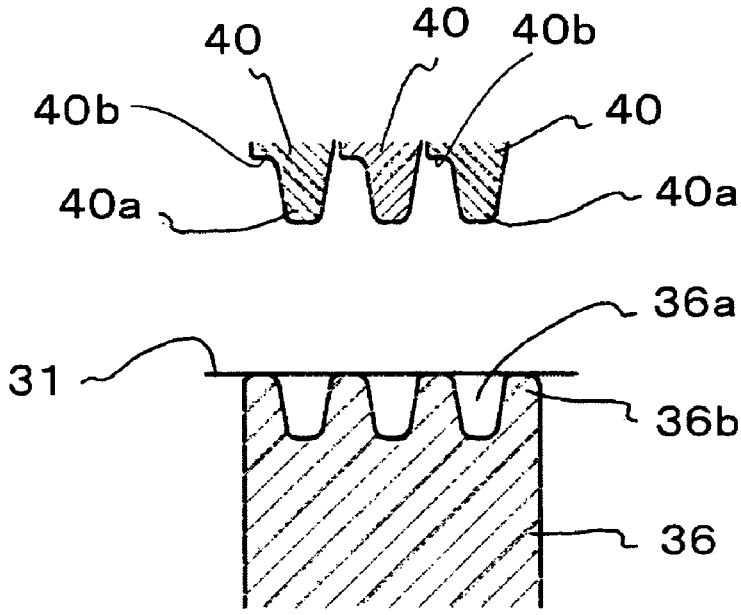
FIG. 7 is an explanation view showing a process of forming the corrugated sections by the punches and a die.
Figure 8:
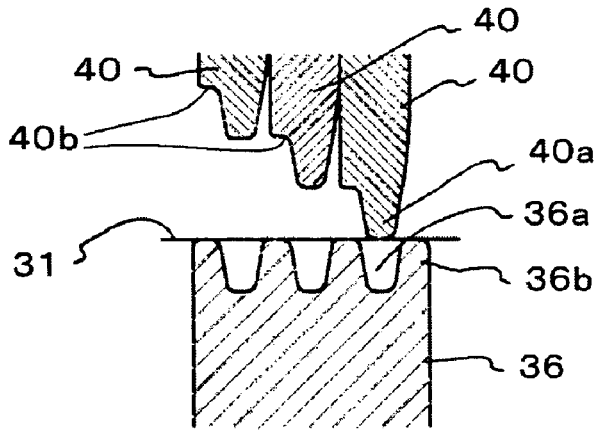
FIG. 8 is an explanation view showing the process of forming the corrugated sections by the punches and the die.
Figure 9:
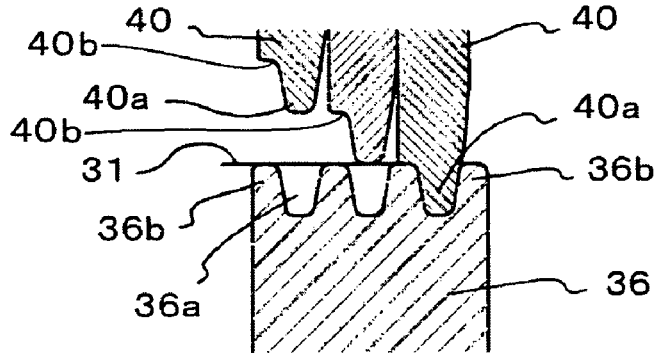
FIG. 9 is an explanation view showing the process of forming the corrugated sections by the punches and the die.
Figure 10:
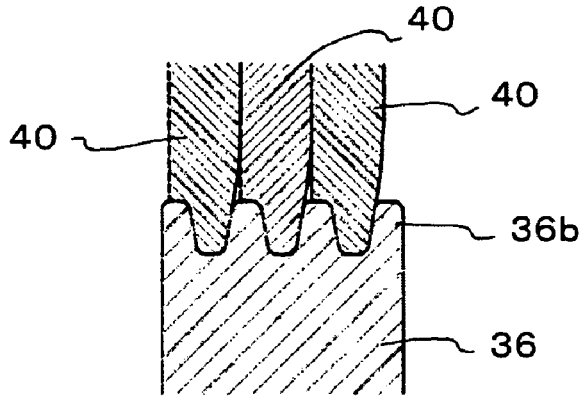
FIG. 10 is an explanation view showing the process of forming the corrugated sections by the punches and the die.
Figure 11:
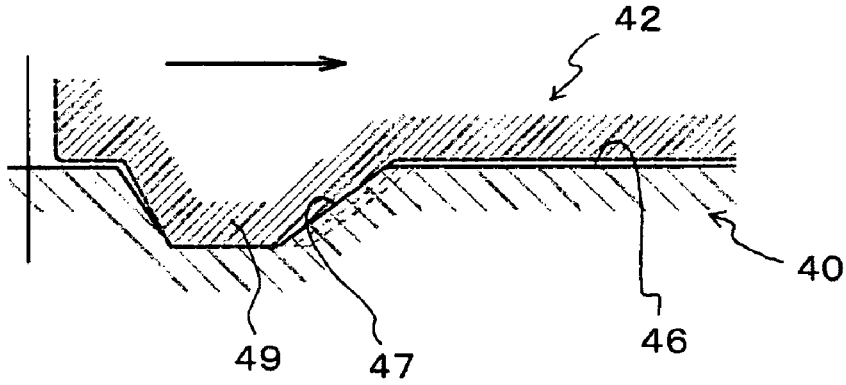
FIG. 11 is an explanation view showing a process of pressing a projection of the punch by a pressing section of a cam block.
Figure 12:
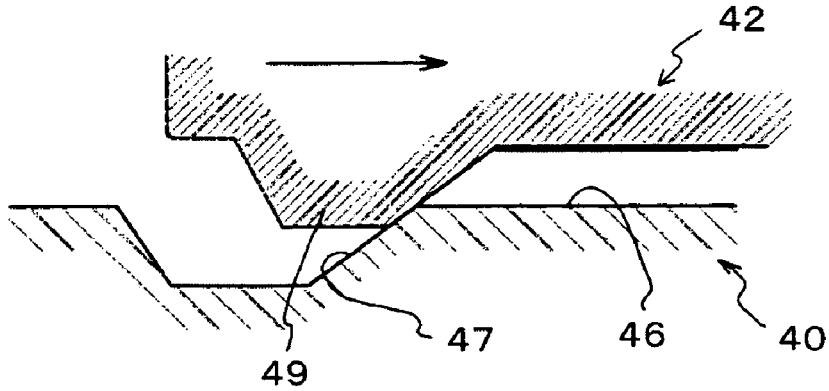
FIG. 12 is an explanation view showing the process of pressing the projection of the punch by the pressing section of the cam block.
Figure 13:
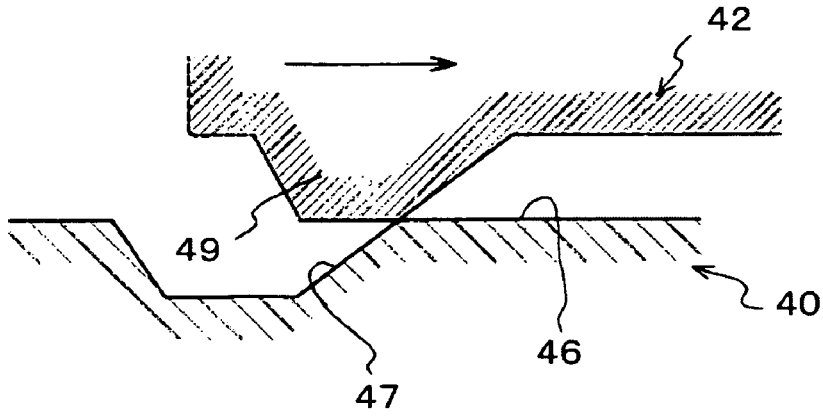
FIG. 13 is an explanation view showing the process of pressing the projection of the punch by the pressing section of the cam block.
Figure 14:
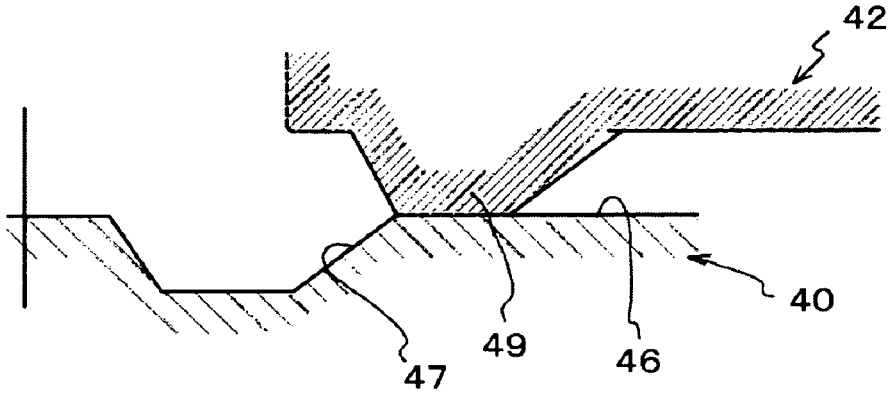
FIG. 14 is an explanation view showing the process of pressing the projection of the punch by the pressing section of the cam block.
Figure 15:
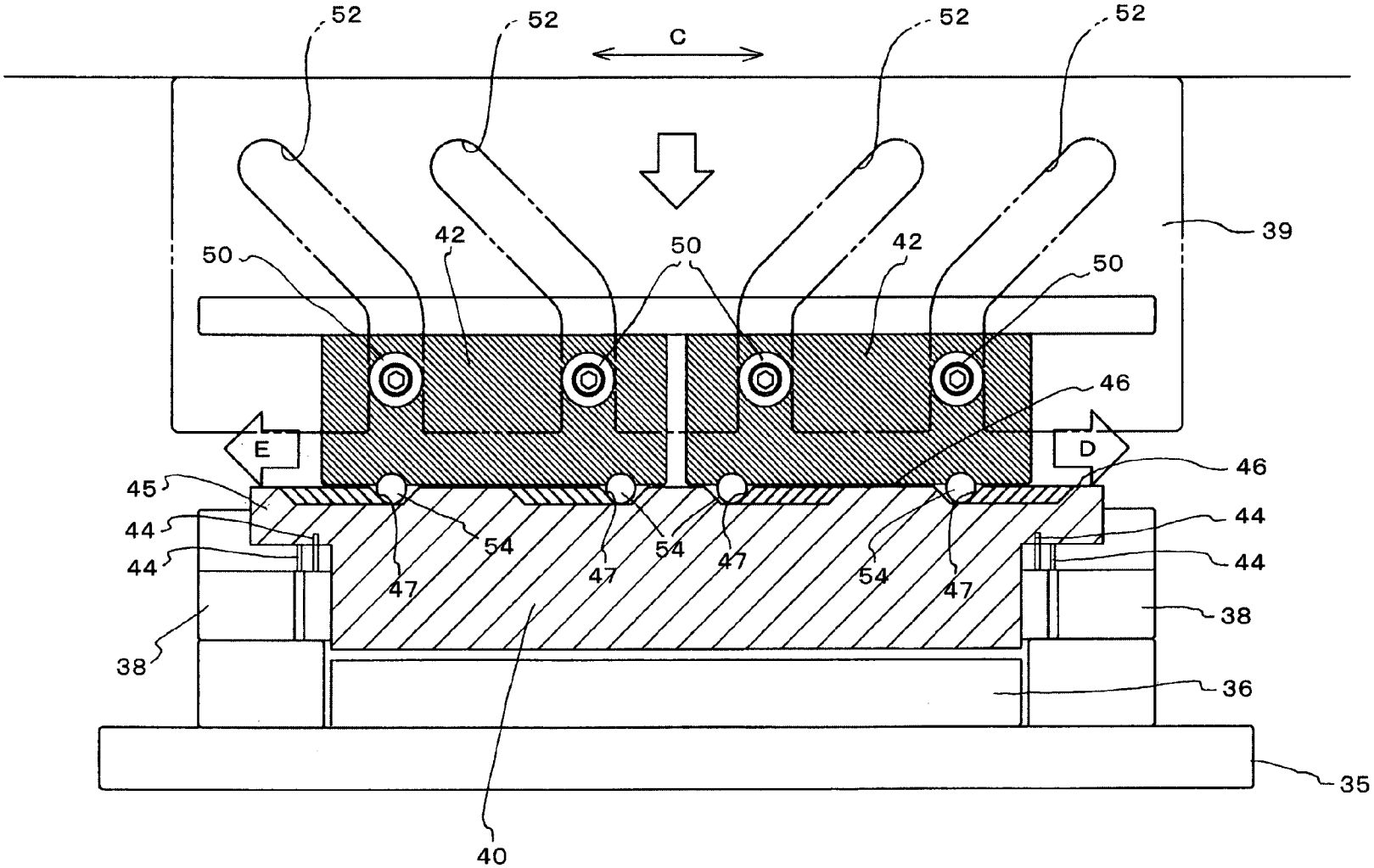
FIG. 15 is a front view of another embodiment of the corrugate fin producing equipment.
Figure 16:
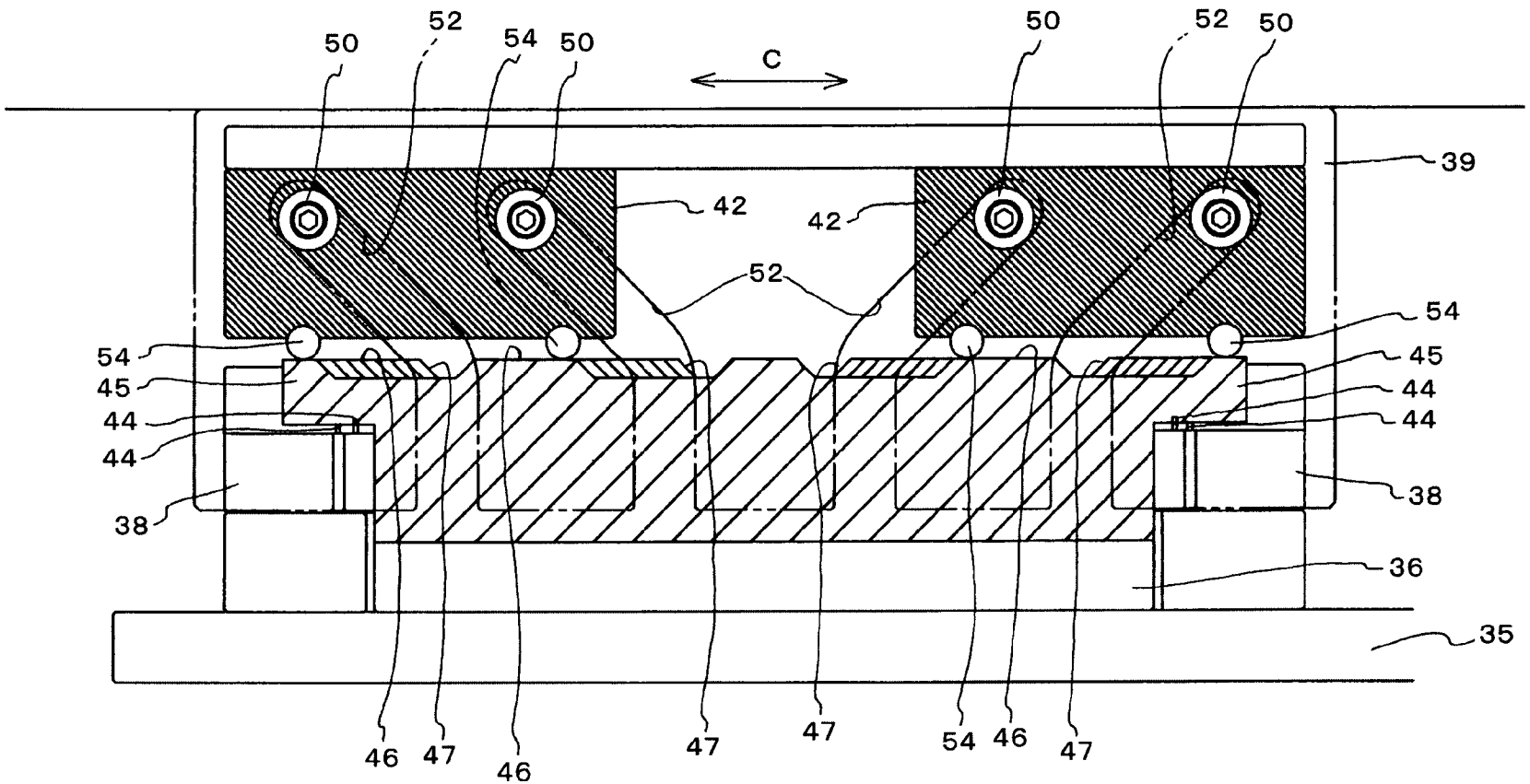
FIG. 16 is a front view of the equipment shown in FIG. 15, wherein all of the punches have been moved downward, and corrugated sections have been formed.
Figure 17:
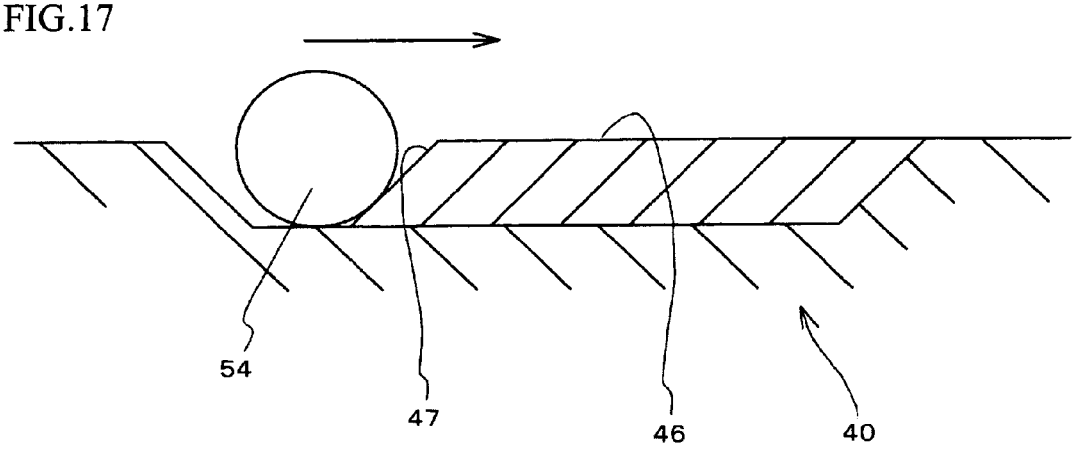
FIG. 17 is an explanation view showing a process of pressing the projection of the punch by a roller of the cam block.
Figure 18:
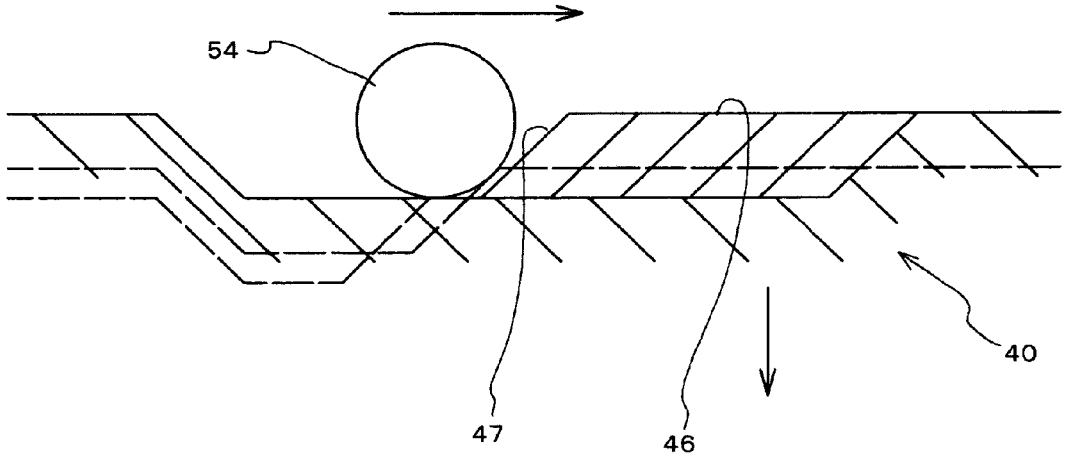
FIG. 18 is an explanation view showing the process of pressing the projection of the punch by the roller of the cam block.
Figure 19:
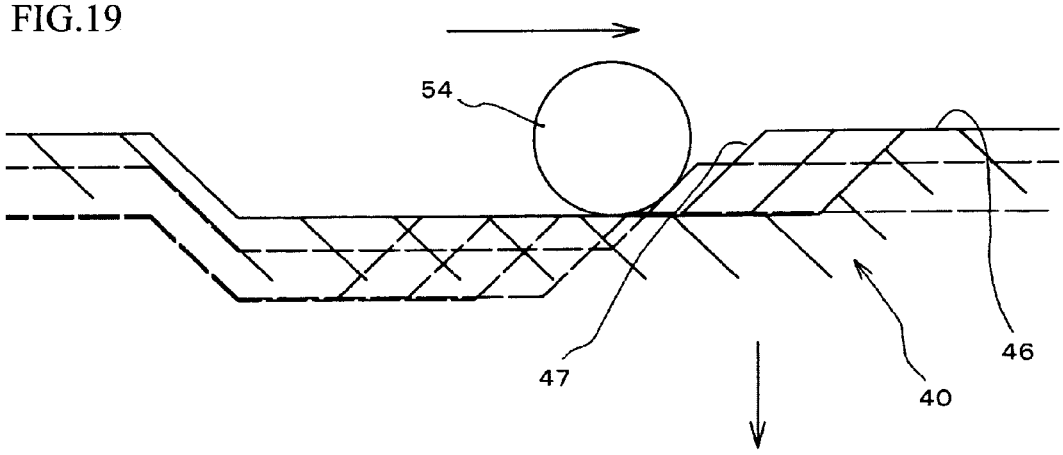
FIG. 19 is an explanation view showing the process of pressing the projection of the punch by the roller of the cam block.

Widths of upper faces of the projections 46 are made wider in order of bending the metal plate 31 (see FIG. 6, in which the punches 40 are partially omitted and the lower sections of the punches 40 are omitted).

In the present embodiment, the corrugated sections 12 are formed in order from a front end of the metal plate 31 in the direction A (see FIG. 1); the punches 40 and the die 36 form the corrugated sections 12 in the metal plate 31 in order in a direction B (see FIG. 2). Therefore, the width of the upper face of the projection 46 of the rightmost punch 40 shown in FIGS. 1-3 is the widest, and the width is made narrower toward the left. So, the width of the upper face of the projection 46 of the leftmost punch 40 shown in FIGS. 1-3 is the narrowest.

In FIGS. 4 and 5, there are eight punches 40. The side slope face 47 of the punch 40, which is firstly moved toward the die 36, is located at the closest position a1 to the pressing section 49 of the cam block 42, and the side slope face 47 of the punch 40, which is secondly moved toward the die 36, is located at the second closest position a2.

Positions of the side slope faces 47 of the punches are gradually remote from the pressing section 49 of the cam block 42 in order of moving toward the die 36. So, the side slope face 47 of the punch 40, which is finally moved toward the die 36, is located at the farthest position a8.

The cam blocks 42 are provided above the punches 40 and always contact the upper faces of the punches 40. Namely, when the upper block 32 and the lower block 34 are opened, the projections 49 of the cam blocks 42 contact parts of the punches 40 other than the projections 46; when the upper block 32 and the lower block 34 are closed, each of the projections 49 of the cam blocks 42 contacts at least one of the projections 46 of the punches 40.

Two cam blocks 42 are respectively provided on the right side and the left side of a center of a width direction C of the punch 40. The cam blocks 42 are capable of moving in the direction C. The movements of the cam blocks 42 are limited by the cam plates 39 of the upper block 32.

In the present embodiment, two cam blocks 42 are located at middle positions in the direction C when the blocks 32 and 34 are opened (see FIG. 4); the cam blocks 42 are mutually separated in the direction C when the blocks 32 and 34 are closed (see FIG. 5).

Two pressing sections 49 are downwardly projected from the bottom face of each cam block 42. Each of the pressing sections 49 is formed into a reverse tapered shape, whose width is gradually reduced toward the lower end. When the blocks 32 and 34 are opened, the pressing sections 49 do not contact the projections 46 of the punches 40 (see FIG. 4). On the other hand, when the blocks 32 and 34 are closed, the cam blocks 42 are moved in the direction C, then each of the pressing sections 49 runs on the side slope face 47 of the widest projection 46 and presses the punch 40 having the widest projection 46 downward against the elasticity of the biasing means 44 (see FIG. 5).

The cam plates 39 of the upper block 32 respectively have cam grooves 52, which respectively accommodate bearings 50 of the cam blocks 42.

The cam grooves 52 are formed to move the cam blocks 42 in the direction C with the downward movement of the cam plates 39. Namely, the cam grooves 52 are diagonally grooved so as to gradually move the bearings 50 in the direction C.

In FIG. 4, the cam grooves 52 for moving the right cam block 42 in a direction D are extended diagonally upward right; the cam grooves 52 for moving the left cam block 42 in a direction E are extended diagonally upward left.

Successively, a method of producing the corrugate fin 10 by the equipment 30 will be explained.

While the blocks 32 and 34 are opened, a feeder unit (not shown) feeds the metal plate 31 between the die 36 and the punches 40.

Then, the upper block 32 is downwardly moved toward the lower block 34 so as to close the blocks 32 and 34. The cam plates 39 are moved downward together with the upper block 32. The bearings 50 of the cam blocks 42 are moved along the cam grooves 52 of the cam plates 39, so that the cam blocks 42 are moved in the horizontal direction.

The cam blocks 42 are respectively moved in the horizontal directions D and E (see FIG. 4) by the cam plates 39, so that they are separated each other.

Then, the pressing sections 49, which are provided in the bottom faces of the cam blocks 42, contact and run on the projections 46 of the punches 40, which will be firstly moved downward. Thus, the punches 40 are pressed downward (see FIGS. 11-14).

When the cam blocks 42 are further moved in the horizontal directions D and E, the pressing sections 49 downwardly press the punches 40 in order of the width of the projections 46. Namely, the punches 40 are pressed downward in order of the distances, which are from the side slope faces 47 to the center in the direction C, with the closest one first.

The punches 40 pressed downward bend the metal plate 31 with the die 36. Since the punches 40 are pressed downward from the rightmost punch 40 in order (see FIGS. 7-10), the corrugated sections 12 can be formed in the metal plate 31 in order.

When the upper block 32 reaches a lower dead point, the pressing sections 49 of the cam blocks 42 locate on the upper faces of the projections 46 of the punches 40, which are finally pressed downward. Then, all of the punches 40 are pressed downward, so that all of the corrugated sections 12 can be formed in the metal plate 31.

Upon completing the formation of the corrugated sections 12, the driving means moves the upper block 32 upward.

The cam plates 39 are moved upward together with the upper block 32, and the bearings 50 of the cam blocks 42 are moved along the cam grooves 52 so that the cam blocks 42 are gradually returned to the initial middle positions (see FIG. 4).

With this action, the pressing sections 49 of the cam blocks 42 are moved away from the upper faces of the projections 46 of the punches 40 in order. Namely, the punches 40 are released from the cam blocks 42 in order of the width of the projections 46 with the narrowest one first. The punches 40 release are moved upward by the biasing means 44. The punches 40 are moved upward in reverse order, and the upper block 32 reaches the upper dead point when the pressing sections 49 of the cam blocks 42 are separated from the projections 46 of all punches 40. When the pressing sections 49 are separated from all of the punches 40, one closing action of the blocks 32 and 34 is terminated.

The metal plate 31, in which the corrugated sections 12 have been formed, is conveyed from the equipment 30 to an accommodating unit. By the above described method, the corrugate fin 10 can be produced.

Next, another embodiment will be explained with reference to FIGS. 15-19. In the present embodiment, rotatable members, e.g., rollers, are used as the pressing sections of the cam blocks. Note that, the structural elements explained in the former embodiment are assigned the same symbols and explanation will be omitted.

Elongated columnar rollers 54 are arranged in the feeding direction A of the metal plate 31 as the rotatable members.

The rollers 45, which contact the projections 46 of the punches 40, are provided to lower ends of the cam blocks 42. The rollers 45 can freely rotatably held at the lower ends of the cam blocks 42. When the cam blocks 42 are moved in the horizontal directions, the rollers 45 can be rotated.

When the upper block 32 is downwardly moved toward the lower block 34 so as to close the blocks 32 and 34, the cam plates 39 are moved downward together with the upper block 32. The bearings 50 of the cam blocks 42 are moved along the cam grooves 52 of the cam plates 39, so that the cam blocks 42 are moved in the horizontal direction.

The cam blocks 42 are respectively moved in the horizontal directions D and E (see FIG. 15) by the cam plates 39, so that they are separated each other.

Then, the rollers 54, which are provided in the bottom faces of the cam blocks 42, contact and roll on the projections 46 of the punches 40, which will be firstly moved downward. Thus, the punches 40 are pressed downward (see FIGS. 17-19). At that time, the rollers 54 roll in the directions D and E and presses the punches 40 downward.

When the cam blocks 42 are further moved in the horizontal directions D and E, the rollers 54 downwardly press the punches 40 in order of the width of the projections 46. Namely, the punches 40 are pressed downward in order of the distances, which are from the side slope faces 47 to the center in the direction C, with the closest one first.

In the present embodiment, the rollers 54 contact the projections 46 of the punches 40, so frictional resistance between the cam blocks 42 and the punches 40 can be reduced. Therefore, the cam blocks 42 and the punches 40 can be smoothly moved, and burning between the cam blocks 42 and the punches 40 can be prevented.

Note that, the elongated columnar rollers 54 are arranged in the direction A, but the rollers are not limited to the present embodiment. For example, a plurality of short rollers may be provided for each of the punches 40.

Figure 20:
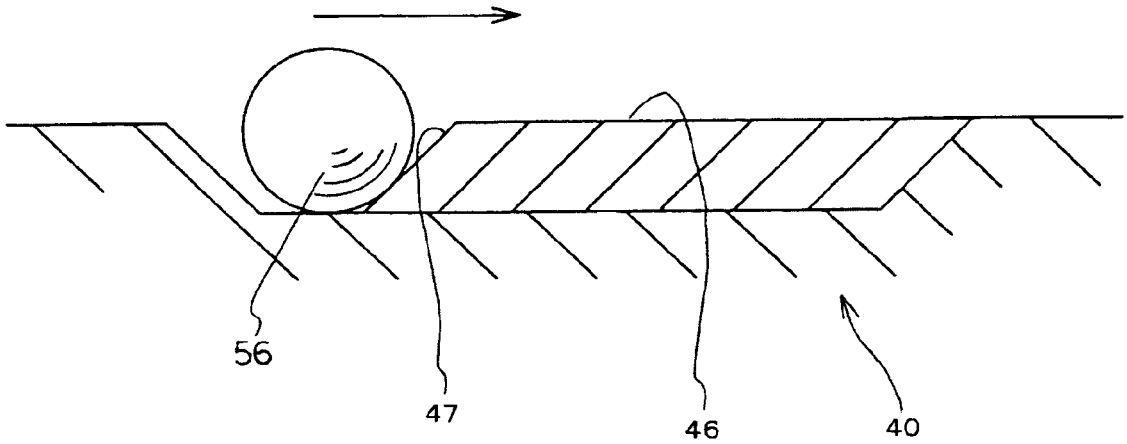
FIG. 20 is an explanation view showing a process of pressing the projection of the punch by a spherical body of the cam block.

Further, spherical bodies 56 (see FIG. 20) corresponding to the punches 40 may be employed, as the rotatable members, instead of the rollers 54.

In the above described embodiments, two cam blocks 42 are located at the middle positions in the direction C when the blocks 32 and 34 are opened, and they are moved away each other when the blocks 32 and 23 are closed.

However, in the present invention, the movements of the cam blocks 42 are not limited to the embodiments. For example, two cam blocks 42 may be located at outer stroke ends when the blocks 32 and 34 are opened, and they may be moved close each other when the blocks 32 and 34 are closed so as to downwardly move the punches 40 in order.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An equipment for producing a corrugate fin having a plurality of corrugated sections from a metal plate, comprising:

a lower die block;

an upper die block being capable of moving to and away from said lower block;

a die being fixed to said lower block;

a plurality of punches being provided to said lower block, located above said die, biased upward by biasing means and capable of independently moving toward said die, said punches respectively having projections, each of which is upwardly projected from an upper face of said punch and each of which has a side slope face;

a pair of cam blocks being capable of relatively moving close and away from each other, said cam blocks respectively having pressing sections, which are formed in bottom faces and which are capable of moving along the side slope faces and contacting the projections of said punches so as to press said punches toward said die against a biasing force of the biasing means; and a cam plate being provided to said upper block, said cam plate relatively moving said cam blocks close or away from each other in a horizontal plane with the movement of said upper block toward said lower block;

wherein positions of the side slope faces of the projections are different so as to make the pressing sections of said cam blocks contact the projections in order when said cam blocks are relatively moved close or away from each other in the horizontal plane, and said cam blocks move said punches toward said die in order, by one closing action of said blocks.

2. The equipment according to claim 1, wherein the pressing sections of said cam blocks are rotatable members, which are capable of freely rotating when said cam blocks are relatively moved close or away each other in the horizontal plane.

3. The equipment according to claim 2, wherein the rotatable members are columnar rollers.

4. The equipment according to claim 2, wherein the rotatable members are a plurality of spherical bodies provided to positions corresponding to said punches.

* * * * *